US005119409A

United States Patent [19]

Nields et al.

[11] Patent Number: 5,119,409

[45] Date of Patent: Jun. 2, 1992

[54] DYNAMIC PULSE CONTROL FOR FLUOROSCOPY

[75] Inventors: Morgan W. Nields; Menachem Assa, both of Englewood; Mark E. Novak, Lafayette; Pascal Perin, Thornton, all of Colo.

[73] Assignee: Fischer Imaging Corporation, Denver, Colo.

[21] Appl. No.: 636,085

[22] Filed: Dec. 28, 1990

[51] Int. Cl.[5] ..... H05G 1/22

[52] U.S. Cl. ..... 378/106; 378/62; 378/99; 358/111

[58] Field of Search ..... 378/106, 101, 99, 108, 378/114, 62, 95; 358/111

[56] References Cited

U.S. PATENT DOCUMENTS

| | | | |
|---|---|---|---|
| 3,567,940 | 3/1971 | Lambert | 378/106 |
| 4,137,454 | 1/1979 | Brandon, Jr. | 378/106 |
| 4,649,558 | 3/1987 | Brunn et al. | 378/97 |
| 4,670,893 | 6/1987 | Tsuchiya | 378/105 |
| 4,703,496 | 10/1987 | Meccariello et al. | 378/99 |
| 4,706,268 | 11/1987 | Onodera | 378/106 |
| 4,837,686 | 6/1989 | Sones et al. | 364/413.19 |
| 4,891,757 | 1/1990 | Shroy, Jr. et al. | 364/413.13 |
| 4,910,592 | 3/1990 | Shroy, Jr. et al. | 358/111 |
| 4,930,144 | 5/1990 | Plut et al. | 378/99 |
| 4,956,857 | 9/1990 | Kurosaki | 378/110 |

*Primary Examiner*—Janice A. Howell
*Assistant Examiner*—David P. Porta
*Attorney, Agent, or Firm*—Sheridan Ross & McIntosh

[57] ABSTRACT

An apparatus and method for dynamically controlling the generation of radiation pulses during pulse-type fluoroscopic imaging. Brightness of an image produced by a pulse is detected, converted to a digital value and compared to an acceptable predetermined value range. If the brightness is not acceptable, the pulse rate is reset to a predetermined, relatively fast rate and the energy level for the next pulse adjusted up or down to increase or decrease the brightness as necessary. Once the brightness is found to be acceptable, the pulse rate is returned to the original pulse rate. If it is determined that motion is occurring, the pulse rate will increase to the relatively fast predetermined pulse rate to provide substantially real-time imaging. If the brightness becomes unacceptable for a pulse during the period of motion, the energy level for the subsequent pulse will be adjusted. This technique of pulse control effectively reduces patient dosage and operator exposure to radiation, provides substantially real-time imaging during periods of relative motion and provides rapid image stabilization times.

16 Claims, 5 Drawing Sheets

DYNAMIC PULSE CONTROL FOR FLUOROSCOPY

BACKGROUND OF THE INVENTION

1. Field of the Invention

The present invention is directed to a method and apparatus for dynamically controlling the generation of x-ray pulses during fluoroscopic imaging. More particularly, the present invention is directed to an apparatus and method for controlling the x-ray pulse frequency during fluoroscopic imaging to compensate for motion and image brightness, reduce radiation dosages and operator exposure and hasten image stabilization.

2. Description of the Related Art

In a conventional x-ray fluoroscopy apparatus, an x-ray source transmits a continuous beam of x-rays through a mass or body, such as a patient. An image intensifier is positioned in the path of the beam opposite the source with respect to the body. The image intensifier receives the emerging radiation pattern from the body (the detected dose) and converts it to a small, brightened visible image at an output face thereof. The output image of the image intensifier is viewed by a television camera and produces a dynamic real time visual image, which can be displayed on a CRT for interpretation or viewing by a doctor or operator and/or can be recorded. The resulting two dimensional image can be used for diagnosing structural abnormalities within the body.

X-rays are absorbed by regions in the body in varying degrees depending upon the thickness and composition of the regions. Accordingly, the ability to see structure in the body using fluoroscopy depends upon the x-ray absorption properties of the structure of interest in the body relative to the x-ray absorption properties of the structures adjacent to the structure of interest. When the difference in absorption between such structures is greater, the greater the contrast and the greater the clarity of the structure. In this regard, a great deal of effort has been put forth to obtain the maximum contrast possible. In one technique, radiographic contrast agents are introduced to a body to provide a difference in x-ray absorption properties where none or little previously existed, such as between soft tissues and blood vessels. For example, a bolus containing iodine or barium, which have x-ray absorption characteristics different than blood, muscle and soft tissues in general, can be introduced into an artery or vein to provide the vascular system with a greater contrast in a certain vascular segment. Digital image processing techniques are also employed to increase contrast. For example, in image subtraction, a field of interest is imaged sequentially using x-ray beams of different energy levels, or using constant energy levels in combination with contrast agents to provide images before the agent has reached the field of interest and then after the agent has arrived. The corresponding images are then digitally subtracted from each other to maximize contrast.

In addition to contrast, the detected dose and motion of or within the body are two factors which affect image quality. The brightness of an image produced by a fluoroscopic system, for example, is directly dependent upon the detected dosage. The detected dose is dependent upon the absorption of x-rays in the field of interest and the strength of the x-ray beam output from the x-ray source. Factors which affect the detected dose for a given diagnostic procedure include the characteristics of the structures within the field of view, the size and weight of the patient and the strength of the x-ray beam. As these factors can vary widely from patient, systems which compensate for these factors have become desirable.

Fluoroscopic systems first developed employed a continuous x-ray beam. In these systems, the strength of the x-ray beam could often be preset to a level deemed appropriate by the operator dependent upon the patient and the procedure. Improved systems were able to automatically adjust the brightness of images produced therefrom by automatically adjusting the strength of the x-ray beam. One such technique involves automatically adjusting the kilovoltage (kV) applied to the anode of the x-ray tube to maintain optimal brightness of the image. Typically, when a decrease in brightness is detected, the kV is increased to increase the x-ray output and hence increase the brightness of the output image, and, conversely, when an increase in brightness is sensed, the kV applied to the anode of the x-ray source is reduced to decrease the x-ray output and subsequently decrease the brightness of the output image. For example, such systems are disclosed or discussed in U.S. Pat. No. 4,703,496 to Meccariello et al. and 4,910,592 to Shroy, Jr. et al.

More recently, systems have been introduced which also adjust the x-ray tube milliamperage (mA) to keep the image brightness constant. Such systems, for example, adjust the x-ray tube photon output by adjusting the level of current (mA) used to heat the filament. However, such systems do not stabilize quickly due to the time required to increase or decrease photon intensity when adjusting the mA, thereby extending the period during which the patient is exposed to radiation. Additionally, by increasing the mA, the patient is exposed to more radiation.

However, problems exist with these systems. Maximum permissible x-ray doses to patients are mandated by health and government organizations. Due to these dosage limitations, the brightness stabilization techniques of these systems cannot always compensate for a decrease in image brightness. Additionally, when the brightness is being adjusted, the image is subject to excessive flicker, and image stabilization time is relatively large. Further, due to an inherent lag in such systems, image smearing is common when motion occurs in the field of view. Image smearing obscures portions of the image and can cause a doctor or operator to miss valuable image information.

Both the Meccariello and Shroy, Jr. patents attempt to resolve the brightness problem at least in part by some kind of television camera gain control. However, when gain is increased, noise is amplified as much as picture information, and no additional information results because the picture information is limited by the strength of the x-ray beam being input to the body. Still, the transition when gain is increased or decreased is not smooth, causing noticeable flickering when increasing and decreasing brightness and requiring time to stabilize the image.

Another problem with all these prior systems is that even though the x-ray dosages may be within limits, they tend to solve brightness problems in part by increasing the amount of x-rays employed. Additionally, long stabilization times in view of motion or a need to adjust for brightness tend to be inherent in the prior systems. While these systems typically do not exceed the maximum prescribed patients dosages, patients are nonetheless exposed to increased radiation levels during periods of adjustment. In view of recent growing concerns regarding exactly how much, if any, exposure to radiation is "safe", limiting exposure levels is becoming a concern in the industry. Possibly of more concern is the amount of x-rays to which an operator will be exposed. However, reducing radiation exposure of patients and operators is simply not adequately addressed by many prior systems.

A relatively recent development which does reduce radiation exposure is pulse progressive fluoroscopy. In pulse progressive fluoroscopy, individual x-ray pulses are generated at what is typically a predetermined rate, and each pulse is converted into an image for viewing until the next pulse is received. While the patient is exposed to less radiation, problems associated with motion and changes in the detected dose are more severe. Stabilization times are extremely long when motion occurs or the detected dose changes.

Given the long stabilization times in the prior art systems, valuable doctor time is wasted and energy requirements for the systems are high. And in this era of ever escalating health care costs, such considerations cannot be taken lightly.

The problems identified above are magnified in view of motion, either by the patient or by the subject of interest within the patient, such as the heart. Some of the prior systems acknowledge this problem and provide some image improvement in view of motion, but at the expense of the problems and drawbacks identified above.

Clearly, a need exists for a fluoroscopic imaging system which provides fast stabilization, lower dosages to patients, and decreased operator exposure when adjustments in response to a change in the detected dose and/or motion in or of the field of interest are being made.

SUMMARY OF THE INVENTION

Accordingly, one object of the present invention is to provide a method and apparatus to stabilize image brightness in fluoroscopy with reduced x-ray exposure to the patient and operator.

A further object of the present invention is to provide an apparatus and method for decreasing the time necessary to stabilize image conditions.

Yet another object of the present invention is to automatically provide brightness control and substantially real time imaging during periods of expected or unexpected motion.

A still further object of the present invention is to reduce the energy requirements for a fluoroscopic device.

Other objects a nd advantages of the present invention will be set forth in part in the description and drawings which follow, and, in part, will be obvious from the description, or may be learned by practice of the invention.

As embodied and broadly described herein, an apparatus for providing an image of a mass comprises a transmitter for transmitting radiation pulses into the mass, a receiver/converter for receiving radiation from each radiation pulse which has passed through the mass and converting the received radiation into an image, means for converting at least a portion of the image into at least one signal, means for comparing a first of the at least one signal with stored data, and means for controlling the transmitting means to adjust the rate at which pulses are generated and/or adjust the energy level at which subsequent pulses will be transmitted based on the comparison of the signal with the stored data. Preferably, the comparing means determines whether a brightness level of the image is within a predetermined range by comparing a digital value representative of the first signal to a predetermined range of values. Further, the comparison is carried out subsequent to the transmission of each radiation pulse to determine whether the brightness level of the image represented by the signal for each pulse is within the predetermined acceptable range. If not, the controlling means commands the transmitting means to adjust the energy level at which the next pulse will be transmitted and reset the pulse rate to a predetermined pulse rate to quickly adjust the brightness level. This energy level adjustment can be carried out for the first pulse upon initiation of imaging to obtain an image having a brightness level within a predetermined range and/or can be carried out during imaging to detect and adjust for brightness changes caused by motion and provide substantially real-time imaging during the motion. Preferably, the predetermined pulse rate is continued until the comparing means determines that the brightness level for the image from the latest pulse is acceptable. Further, the comparing means can further detect motion using image analysis. Preferably, a pixel-by-pixel comparison of image information from the digitized first signal to image information from a previous digitized signal from a preceding pulse is carried out to determine whether motion is occurring. If at least a predetermined number of pixels have undergone a significant change from pulse to pulse, the control means then causes the transmitting means to adjust the pulse rate to a predetermined pulse rate to effect substantially real time imaging until the comparing means determines that the motion has ceased.

A method according to the present invention for adjusting the images produced by a pulse-type fluoroscopy apparatus comprises the steps of converting at least a portion of an image into at least one representative signal, comparing a first signal to stored data, resetting the pulse rate to a predetermined pulse rate if the comparing determines that motion is occurring or if the brightness level is not within a predetermined acceptable range, and adjusting the energy level at which at least one subsequent pulse will be transmitted if the brightness level is not within the acceptable range and/or if motion is discovered. The converting step can comprise the substeps of converting at least a portion of the image into a current representative of the brightness of the portion of the image, converting the current into a corresponding voltage and converting the voltage into a corresponding digital value, wherein the comparing step further comprises comparing the digital value to a predetermined range of values to establish whether the brightness level is within a predetermined acceptable range. Further, the converting step can comprise converting the image into a video signal, converting the video signal into a corresponding digital signal, wherein the comparing step comprises a pixel-by-pixel comparison of at least a portion of the image represented by the digital signal to a corresponding portion of an image represented by a stored digital signal from a previous pulse. If a significant change has occurred in at least a predetermined number of pixels, the pulse rate is adjusted to provide substantially real-time imaging.

The present invention will now be described with reference to the following drawings, in which like reference numbers denote like elements throughout.

DESCRIPTION OF THE PREFERRED EMBODIMENTS

Figure 1:
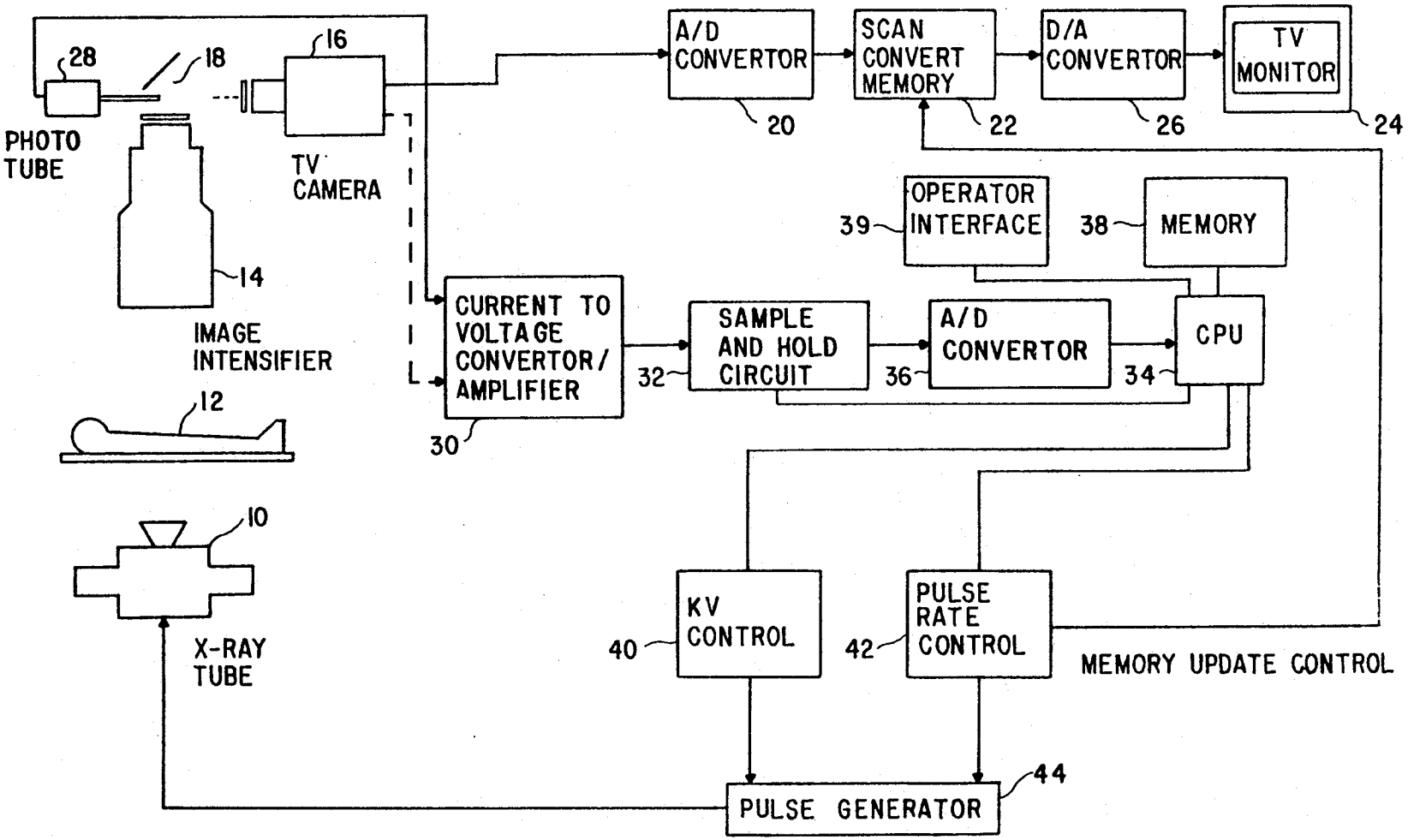
FIG. 1 is a block diagram of a fluoroscopic imaging system which provides dynamic pulse and kVp control according to a first embodiment of the present invention.
Figure 2:
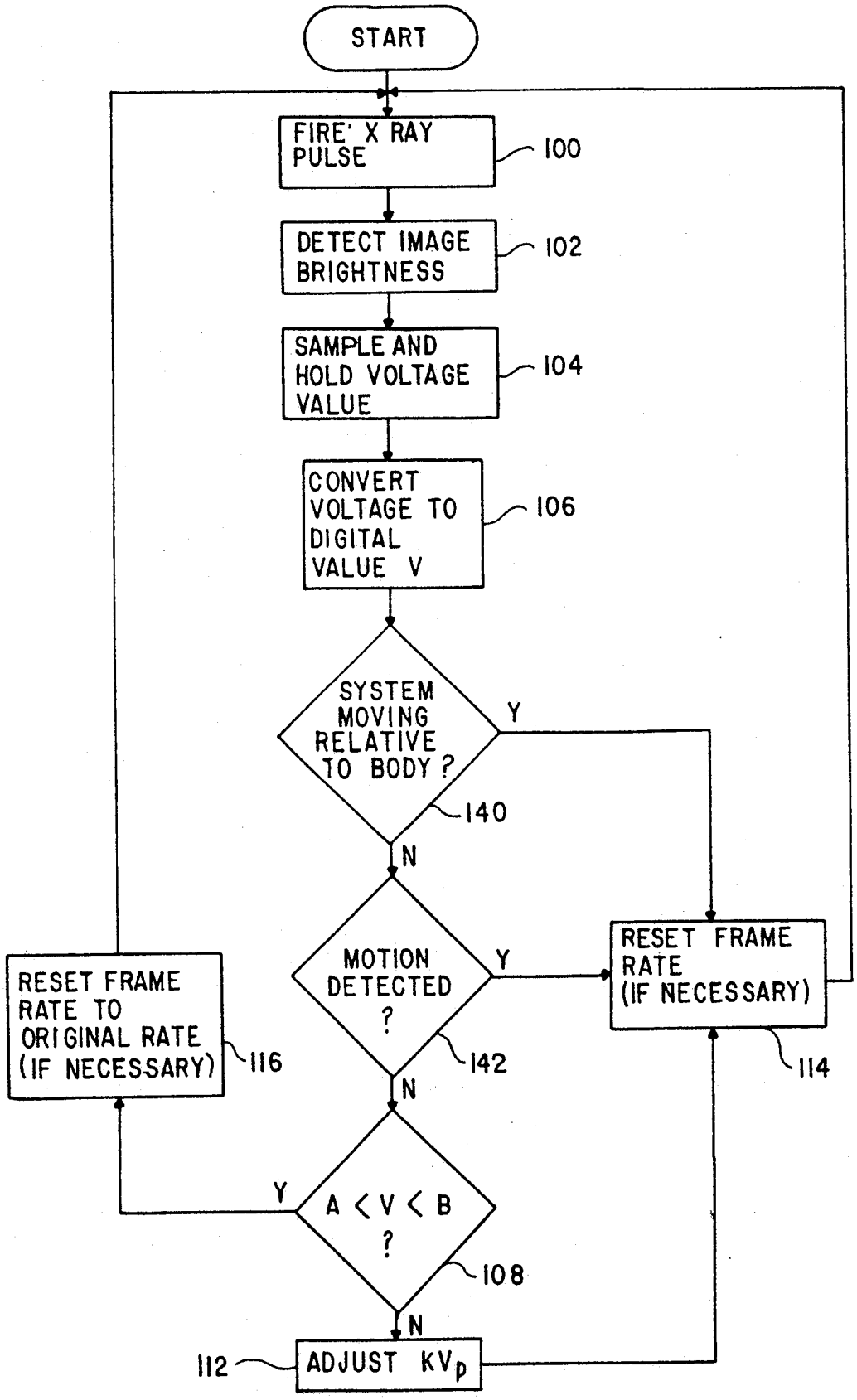
FIG. 2 illustrates a flowchart of a control process according to the present invention.

A first embodiment of the present invention will now be described referring to FIG. 1 and the flowchart of FIG. 2. As in a conventional fluoroscopic system, a desired pulse rate (frames per second) and kilovoltage (kV) are selected or set based on the procedure to be carried out, the characteristics of the mass to be subjected to the x-rays, etc. The kV typically ranges between 40 and 100 peak kilovolts per pulse (kVp). When the procedure is initiated, a first x-ray pulse having the prescribed kV is generated by an x-ray tube 10 (step 100). Preferably, the x-ray pulse width is very narrow, on the order of three or four milliseconds (msec), and the width will preferably remain constant, even though pulse rates and kV values will vary. One advantage to using short pulses is that dosages can be limited and patient and operator exposure to x-rays kept to a minimum. Additionally, short pulses provide excellent image freezing, substantially eliminating image smearing in the presence of motion.

The first pulse is transmitted through a mass 12 to be imaged and is received by an image intensifier 14, where it is converted into a visible image. The mass 12 may be a patient, wherein the x-ray pulse is transmitted through the portion of the patient which is to be imaged. The image output by the image intensifier 14 is available for viewing. Preferably, the image is converted to a video signal. For example, a progressive scan TV camera 16 views the output image via an optical coupling system 18, which includes a tandem lens system and a mirror. For example, the image from the image intensifier 14 viewed by the TV camera 16 passes through a coupled lens of the tandem lens system and is reflected off the mirror to a matched lens of the tandem lens system associated with the TV camera 16. The matched lens focusses the image on the camera tube (not shown) of the TV camera 16, where it is converted to the video signal. The mirror is typically utilized between the lenses to reduce the overall height of the system.

The video signal representative of an image created by an x-ray pulse is then forwarded to an analog-to-digital converter 20, where the signal is digitized. The digitized signal is forwarded to a scan convert memory 22, where it is stored for first updating and then refreshing the image on a TV monitor 24 until the image from the next x-ray pulse is available. The imaging is performed by progressive scanning of the camera tube, which avoids the flicker problem associated with images captured with conventional interlay scanning when using pulsed radiation imaging techniques. The scan convert memory 22 permits conventional 60 hz vertical scanning of conventional display monitors to be employed and enables the TV monitor 24 to be refreshed between pulses. The image displayed is updated with a new image when the scan convert memory 22 receives and stores data from the next x-ray pulse.

Preferably, a photomultiplier tube 28 is also positioned proximate to the face of the image intensifier 14 for viewing the image output by the image intensifier 14. The photomultiplier tube 28 produces an electric signal in the form of a current which is a function of the average brightness of at least a portion of the image output by the image intensifier 14 (step 102). As mentioned previously, the brightness of the image is a function of the detected dose. Typically, the photomultiplier tube 28 will be positioned to detect the brightness of the center 30% of the image, which will then be converted to a representative current. The current produced by the photomultiplier tube 28 is converted to a voltage representative of the brightness and amplified in a current-to-voltage converter 30. The representative voltage is then supplied to a sample and hold circuit 32, which is controlled by a CPU 34 to sample the voltage corresponding to the peak or center of the x-ray pulse (step 104). The voltage representing the brightness is output by the sample and hold circuit 32 to an analog-to-digital converter 36.

Preferably, the A/D converter 36 converts the voltage into a twelve bit digital value V (step 106), although other bit lengths are possible. The digital brightness value V is immediately forwarded to the CPU 34, which is preferably an eight bit microprocessor, such as a Z-80 microprocessor from Zilog. The digital brightness value V is then compared by the CPU 34 with a predetermined acceptable value range to determine whether V is within the predetermined acceptable range (step 108). Since the voltage is converted into a twelve bit binary number, the brightness can be represented by any one of 4096 different values. This provides a very sensitive estimation of the brightness. The predetermined range of acceptable values is stored in memory 38 and represents an acceptable brightness (i.e., greater than a predetermined value A and less than a predetermined value B). As will be appreciated by those skilled in the art, a range of values is provided on the basis of the sensitivity of the system and to take noise into consideration for preventing excessive and unnecessary adjustment of the kVp value.

If it is determined that the value V is within the acceptable range, the subroutine (steps 100–108) can be exited until the next diagnostic procedure is initiated or a new frame rate selected or set by an operator via an operator interface 39, which can be a control panel or computer terminal in communication with the CPU 34. Alternatively, the system can wait until the next synchronization pulse, which effects the firing of the next radiation pulse, and repeat the subroutine relative to the next pulse, and/or go into a waiting mode for activation when planned motion between the system and the mass is initiated or if motion is detected within the field of view, as will be explained below.

If the value V is found not to fall within th predetermined acceptable range in step 108, two steps are immediately taken. First of all, depending upon whether the value V is greater than or less than the acceptable range and the quantity which represents the difference between the value V and the acceptable range, the CPU 34 sends an appropriate command signal to a kV control 40 so that the kVp for the next pulse is adjusted down or up, respectively, (step 112). For example, when the difference between the value V and the range is more than a predetermined quantity above or below the range, the CPU 34 commands the kV control 40 to adjust the kVp for the next pulse down or up by two (or more) kV, respectively. When the difference is less than the predetermined quantity, the kVp is adjusted down or up by one kV for the subsequent pulse.

In addition to adjusting the kVp for the second pulse, the CPU 34 sends an appropriate signal to a pulse rate control 42 so that frame rate is reset in order to rapidly adjust the brightness (step 114). Preferably, the number of pulses (frames) per second is set to the maximum value possible in the system. On fluoroscopy systems available today, the maximum rate is typically thirty frames per second. By using the highest rate possible, given the fast response time of the system in changing the kVp, the brightness adjustment will take less than a second. Given that the kVp will be adjusted following each pulse for the subsequent pulses until the appropriate kVp level is reached, patient dosage and operator radiation exposure are reduced in comparison to systems which take much longer to adjust for brightness, since the entire adjustment will typically be completed after just a few narrow pulses.

Once the pulse rate control 42 has been reset and the kV control 40 adjusted, a generator 44 is controlled by the kV control 40 and the pulse rate control 42 to cause the x-ray tube 10 to generate the second pulse (step 100). The second pulse preferably has the same pulse width as the first pulse but an adjusted kVp. The pulse rate control 42 causes the second pulse to be transmitted almost immediately, rather than at the preset rate, due to the change in the pulse rate. The same process with regard to the brightness and kVp adjustment (steps 102–112 is repeated before the next pulse can be generated and for subsequent pulses until the sampled brightness value V is acceptable, with the pulse rate remaining at the new level until the brightness is acceptable. As indicated in the flowchart, the brightness of the image produced by the image intensifier 14 pursuant to the second pulse is detected by the photomultiplier tube 28 (step 102). The current produced by the photomultiplier tube 28 corresponding to the brightness of the image produced by the second pulse is converted into a corresponding voltage and amplified in the current-to-voltage converter 30. The portion of the voltage output by the current-to-voltage converter 30 representing the center of the second pulse is then sampled and held by the sample and hold circuit 32 (step 104), from which it is fed to the A/D converter 36 (step 106). The digital representation V of the brightness is then sent to the CPU 34, which determines whether the value V falls within the predetermined range (more than a first value A but less than a second value B) for acceptable brightness (step 108). If the value V falls within the acceptable range, the CPU 34 causes the pulse rate control 44 to return the frame rate to the original preset frame rate (step 116). The x-ray procedure is then continued at the original frame rate but at the final adjusted kVp, with the possibility that the kVp adjustment process could be initiated again if so warranted by a change in conditions.

If the value V is found not to fall within the predetermined acceptable brightness range in step 108, CPU 34 causes the kV control 40 to adjust the kVp of the next pulse (step 112), and steps 102 through 112 are repeated for the third pulse and subsequent pulses until the brightness is found to be in the acceptable range. Given that pulses are fired at the rate of 30 pulses per second, the adjustment of the kVp is quite fast, typically resulting in the kVp being adjusted to the appropriate brightness in a matter of several pulses, which in elapsed time is a fraction of a second.

Alternatively, the need for adjusting the brightness can be detected using the signal output by the TV camera 16. In accordance with known techniques, the synchronization pulse of the video image signal output by the TV camera 16 is removed, and the brightness of the remaining video image signal averaged to provide a representative current, which is supplied to the current-to-voltage converter 30. The voltage output by the current-to-voltage converter 30 is then be treated in the same manner as voltage obtained from the photomultiplier tube 28.

In addition to this basic brightness adjustment capability during procedure initiation, the present invention permits image adjustments to be carried out at any time during the procedure. Causes which can necessitate adjustments include motion of the patient, motion of the object of interest within the patient, introduction of a bolus to the field of interest within the patient, or planned motion of the patient relative to the x-ray tube 10 during the diagnostic procedure. These possibilities can be grouped into two or three categories for the decision making process, and are accounted for by the present invention in the following manner.

As discussed above, steps 100 through 108 can be repeated for each pulse generated during a diagnostic procedure to ensure that the brightness will remain acceptable. By continuously running this procedure, it is possible to detect and adjust for brightness changes caused by any number of different reasons, such as many types of motion within the body 12 or of the body 12 relative to the x-ray tube 10. For example, motion which causes a change in the average brightness detected by the photomultiplier tube 28 will cause a change in the value V. If the new value V is found not to fall within the predetermined range in step 108, the kVp adjustment/frame rate increase process of steps 112 and 114 is triggered, thereby increasing the pulse rate and adjusting the kVp. Additionally and possibly more importantly, an operator or doctor will be able to view the motion in or of the field on the TV monitor 24 in substantially real time. Real time viewing of the motion is realized because the image on the TV monitor 24 is being refreshed 30 times per second during the kVp adjustment in response to the brightness change.

Figure 3:
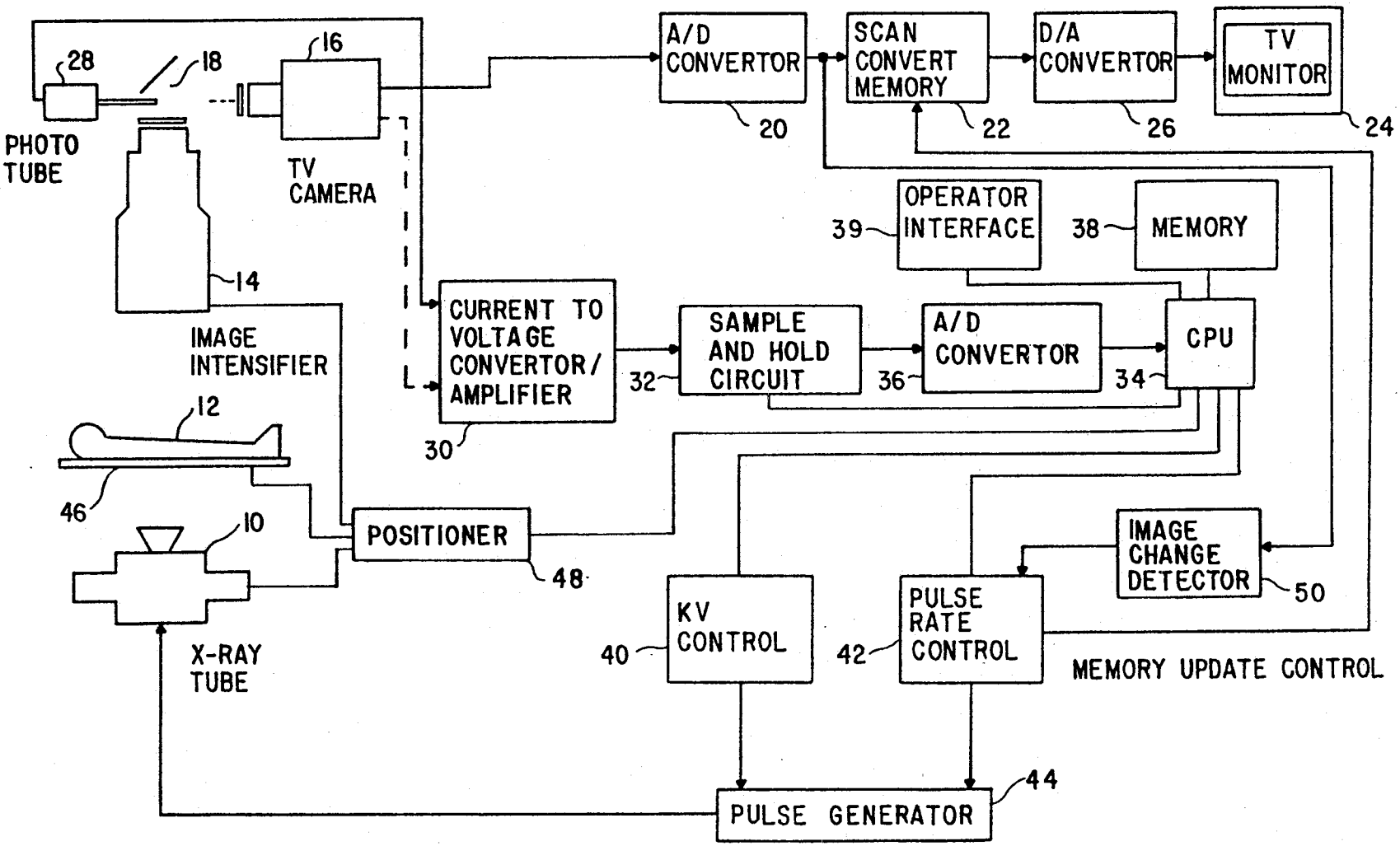
FIG. 3 is a block diagram of a fluoroscopic imaging system which provides dynamic pulse control and kVp control according to a second embodiment of the present invention.

However, during a diagnostic procedure, several events can happen in the field of view which can be of interest and will alter the image produced at the TV monitor 24 but will not necessarily be detected using the photomultiplier tube 28. As described above, the photomultiplier tube 28 monitors the average brightness in at least a portion of the image. If the change in brightness is not significant enough to substantially alter the value V so as to trigger the kVp adjustment portion of the subroutine, or if the change in brightness does not occur within the portion of the image monitored by the photomultiplier tube 28, or if the average brightness does not change within the portion being monitored (i.e., in view of motion within the monitored portion), the kVp adjustment portion of the subroutine will not be triggered and the frame rate will not be increased to provide substantially real time imaging. Accordingly, the present invention includes features which provide for these possibilities in a second embodiment, which illustrated in FIG. 3 and discussed below.

During the course of a diagnostic procedure, the above discussed subroutine can be run for each pulse. In this case, any change in image brightness which causes the value V to deviate from within the acceptable range of values will trigger the kVp adjustment portion of the subroutine (step 112). As mentioned, a number of changes within the field of interest or to the field of view may not change the value V sufficiently to trigger the kVp adjustment and faster pulse rate. However, these changes can affect the image and/or the ability of the operator or doctor to view exactly what is happening within the field of interest/field of view. The changes of concern are primarily motion related. Accordingly, additional decision-making steps may be included within the above-discussed subroutine and/or additional elements added to the system which function to trigger the kVp adjustment/frame rate increase portion of the subroutine.

During certain diagnostic procedures, it may be desirable to move the patient 12 relative to the x-ray tube 10 and the image intensifier 14. This may be performed either by moving a table 46 (FIG. 3) on which the patient 12 is positioned, by moving the x-ray tube 10 and the image intensifier 14, by moving the patient 12, or by some combination of these movements. Typically, such movements are effected by a positioner 48, which, under control of the CPU 34 or manual control, controls motors (not shown) which cause the x-ray tube 10, image intensifier 14 and/or the table 46 to move as desired.

If the pulse rate is one pulse per second, which is common when the structure of interest is bone, the image on the TV monitor 24 is updated only once each second (although it will be refreshed at a rate of 30 frames/ second between pulses with the image stored in the scan convert memory 22). During motion, items of interest which become visible only between pulses will not be available for view on the TV monitor 24 to a doctor or operator and will be lost. To compensate for this motion, the system according to the second embodiment can be programmed to automatically increase the pulse rate in the event of planned motion. By increasing the pulse rate (and thus the image update rate) to 30 pulses per second, a doctor or operator will be provided with a substantially real time image of the object of interest during the period of relative motion. Additionally, if the brightness changes during the motion, kVp adjustment will be carried out as required, keeping the images on the TV monitor 24 substantially at optimal brightness during the period o relative motion.

Forcing a pulse rate increase during planned motion can be implemented with either an independent subroutine or with logic steps built into the primary subroutine. When steps are to be included in the primary subroutine, prior to the comparison of the value V to the desired range in step 110, the system can be queried as to whether planned relative motion between the system and the mass 12 is being initiated or occurring (step 140). If the motion is programmed, the CPU 34 will have that information and automatically trigger the pulse rate increase. If the motion is caused by manual control of the positioner 48, this information will be forwarded to the CPU 34, and the pulse rate increase triggered (step 114).

In addition to planned relative motion, motion within the body 12 or of the body 12 may or may not result in a brightness change which is detectable by the photomultiplier tube 28. Accordingly, supplemental means can be employed to detect such motion. The present invention provides for supplemental motion detection in the following manner. The analog picture data output by the TV camera 16 is first converted to digital data by the A/D converter 20. An image change detector 50 then receives the digital picture data. The image change detector 50 includes a frame memory which stores data from each pixel of the image. Typically, data for each pixel is stored in the form of an eight bit gray scale, although the gray scale can contain other numbers of bits, such as 10 or 12 bits, and the following procedure can be carried out using these other number of bits. When digital picture data from the subsequent x-ray pulse is received from the A/D convertor 20, a pixel-by-pixel comparison takes place. An arithmetic logic unit compares the gray scale for each corresponding pixel in the two images. Preferably, the gray scale value for the each pixel in the second image is subtracted from the gray scale value for each corresponding pixel in the first image. The difference in values for each pixel is then forwarded to a threshold detector, which determines whether the difference is more than a predetermined amount, typically the two or three bits which can be attributed to noise. If the difference is greater than the threshold value, a counter is incremented by one. Upon completion of the comparison, if the value of the counter is more than a predetermined number, indicating that a significant change has taken place in at least a number of pixels deemed significant, then the pulse rate increase portion of the subroutine (step 114) is triggered. This motion detection is indicated in the flowchart of FIG. 2 as step 142.

The image change detector 50 described above employs but one of many techniques for detecting motion now available. While the described technique is presently preferred, motion can be digitally detected using any one of these techniques.

Figure 4:
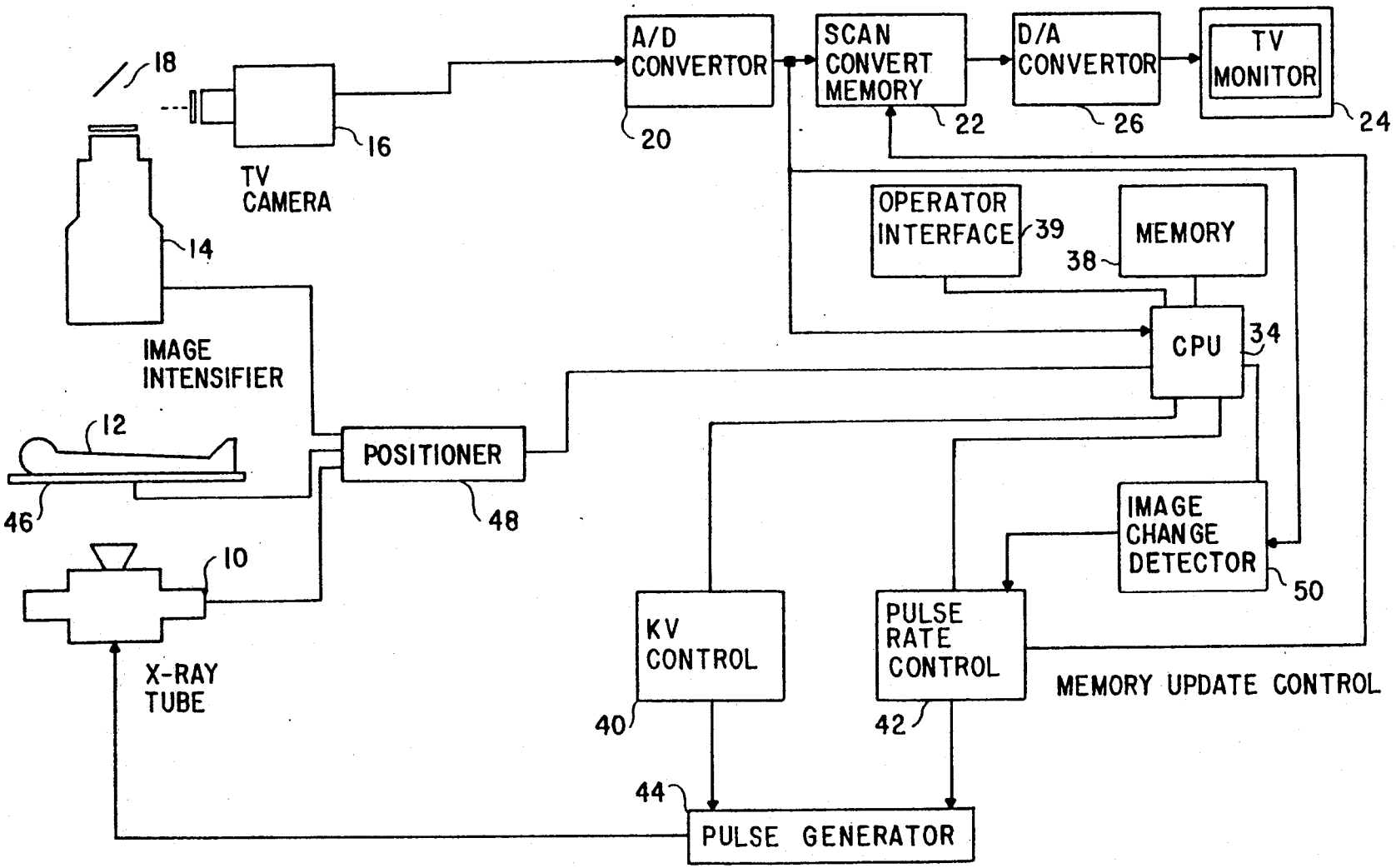
FIG. 4 is a block diagram of a fluoroscopic imaging system according to a third embodiment of the present invention.
Figure 5:
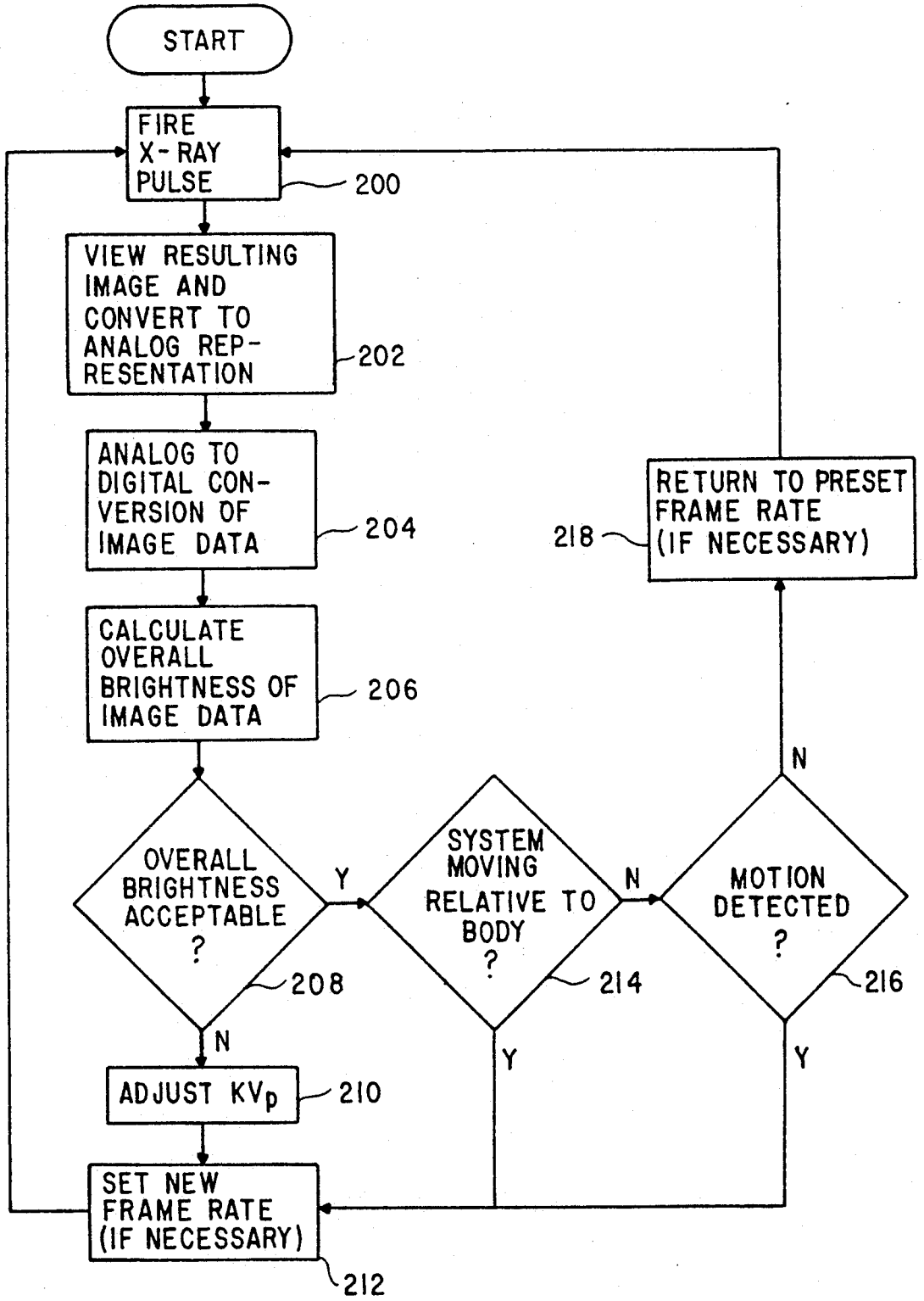
FIG. 5 is a flowchart of a control process for the embodiment of the present invention illustrated in FIG. 4.

In addition to use in motion detection, digital techniques can be employed to detect brightness levels in place of the photomultiplier tube and can be employed to detect changes in brightness. Such a system is provided in a third embodiment of the present invention, which is illustrated in FIG. 4. In addition to motion, changes in brightness can certainly be established during a pixel-to-pixel comparison within the field of interest by th image change detector 50. Additionally, the overall brightness of the entire image can be calculated digitally, and changes in the kVp made in response to the calculated value. This process is illustrated in the flowchart of FIG. 5.

As with the process discussed above relative to the flowchart of FIG. 2, upon the firing of an X-ray pulse through a body (step 200), an image is output by the image intensifier 14. The image is viewed by the TV camera 18 and the viewed image is converted to analog picture data by the TV camera 16 (step 202). The analog picture data is converted to digital picture data in the A/D converter 20 (step 204). The digital picture data is forwarded not only to the image change detector 50, but also to the CPU 34. Based on the gray-scale value of each pixel, an average brightness for the image output by the image intensifier 14 is calculated by the CPU 34 (step 206). The calculated value is compared to an acceptable value range which can be stored in the memory 38 in order to determine if the brightness of the image is acceptable (step 208). If the value is not acceptable, then a kVp adjustment/pulse rate increase portion of the subroutine is entered which is substantially identical to the corresponding portion of the subroutine provided relative to FIG. 2. That is, the kVp is adjusted depending upon the difference between the calculated brightness value and the acceptable brightness range (step 210), the frame rate is set to a relatively fast rate, such as 30 frames per second (step 212), and the next X-ray pulse is fired and a determination is made whether the kVp adjustment has made the average brightness of the image acceptable.

Like the embodiments described above, even if the overall brightness is found to be acceptable in step 208, a determination can then be made if the system is moving relative to the body (step 214), and if so, the frame rate can be increased (step 212) to provide substantially real time imaging, the system maintaining the capability to adjust the kVp as necessary. Also, as described above, even if the system is not moving relative to the body, if the image change detector 50 detects a brightness change in a sufficient number of pixels from pulse to pulse (step 216), then the relatively fast frame rate can be set (step 212).

The described steps can then be repeated for each subsequent pulse. If the frame rate has been increased, the frame rate will return to the originally set rate when the kVp is acceptable and/or when the motion has ceased (step 218). If the kVp was found to be acceptable for the first pulse, the brightness and motion can be monitored for any need to adjust the kVp (step 210) and/or increase the frame rate (step 212) as conditions warrant for each subsequent pulse.

In all of the embodiments, by increasing the frame rate when motion is detected, several purposes are served. First, the image on the TV monitor 24 will be updated substantially on a real time basis while the motion is taking place, thereby allowing the doctor or operator to view changes within the field of view as they occur. Secondly, the brightness changes caused by motion or changes within the field of view will also be viewable on a substantially real time basis. All the while, brightness will be maintained at or near optimum levels. Additionally, when the motion finally stops, the pulse rate will automatically be reset to the originally set pulse rate, thereby reducing the patient dosage and minimizing exposure to the operator or doctor.

As discussed above, the pulse rate control 42 controls the pulse rate for the x-rays produced by the x-ray tube 10. In each embodiment described herein, pulse rate data is also forwarded to the scan convert memory 22 which, based on this data, replaces its stored picture data with data from the next pulse and updates the image on the TV monitor 24 as the image from each pulse is received by the scan convert memory 22.

While several embodiments of the present invention have been discussed, it will be appreciated by those skilled in the art that various modifications and variations are possible without departing from the spirit and scope of the invention.

What is claimed is:

1. An apparatus for providing an image of a mass comprising:

means for transmitting radiation pulses into the mass;

means for receiving radiation from each transmitted radiation pulse which has passed through the mass and converting the received radiation from each pulse into an image;

means for converting at least a portion of the image into at least one signal;

means for comparing the at least one signal with stored data;

means for controlling said transmitting means to adjust the pulse rate and the energy level of subsequent pulses based on results of the comparison by said comparing means.

2. An apparatus according to claim 1, wherein said comparing means determines whether a brightness level of at least the portion of the image represented by said at least one signal is acceptable.

3. An apparatus according to claim 1, wherein the subsequent to a radiation pulse output by said transmitting means, said comparing means determines whether a brightness level of at least the portion the corresponding image represented by said at least one corresponding signal for the pulse is acceptable, and, if not, said controlling means controls said transmitting means to automatically adjust the pulse rate and energy level at which a next radiation pulse is transmitted.

4. An apparatus according to claim 3, wherein said transmitting means is automatically adjusted until said comparing means determines that the brightness level of the image corresponding with a subsequent pulse is acceptable.

5. An apparatus for providing an image of a mass comprising:

means for transmitting radiation pulses into the mass;

means for receiving radiation from each transmitted radiation pulse which has passed through the mass and converting the received radiation from each pulse into an image;

means for converting at least a portion of the image into at least one signal;

means for comparing the image data represented by said at least one signal to image data from a previous pulse to determine whether motion is occurring in a field of view; and means for controlling said transmitting means to adjust the pulse rate and the energy level of subsequent pulses based on results of the comparison by said comparing means.

6. An apparatus according to claim 5, wherein if said comparing means determines that motion is occurring, said controlling means causes said transmitting means to transmit pulses at a predetermined high rate until said comparing means determines that the motion has ended.

7. An apparatus for providing an image of a mass comprising:

means for transmitting radiation pulses into the mass;

means for receiving radiation from each transmitted radiation pulse which has passed through the mass and converting the received radiation from each pulse into an image;

means for converting at least a portion of the image into at least one signal;

means for comparing the at least one signal with stored data;

means for controlling said transmitting means to adjust the pulse rate and the energy level of subsequent pulses based on results of the comparison by said comparing means; and means for determining whether planned relative motion between the mass and said apparatus is occurring, and if so, said controlling means causes said transmitting means to transmit radiation pulses at a predetermined pulse rate to effect substantially real-time imaging until said determining means determines that the relative motion has ended.

8. A method for adjusting images produced by a pulse-type fluoroscopy apparatus, comprising the steps of:

(a) converting at least a portion of an image produced from a radiation pulse into at least one representative signal;

(b) comparing the at least one signal to stored data;

(c) resetting the pulse rate to a predetermined pulse rate if it is determined in said step (b) that motion is occurring or if a brightness level is unacceptable; and (d) adjusting the energy level at which a subsequent pulse will be transmitted if it is determined in said step (b) that the brightness level is unacceptable.

9. A method according to claim 8, wherein said step (a) comprises the substeps of:

(i) converting at least a portion of the image into a current representative of the brightness of the image;

(ii) converting the current into a corresponding voltage; and (iii) converting the voltage into a corresponding digital value; and wherein said step (b) further comprises comparing the digital value to a predetermined acceptable range of values.

10. A method according to claim 8, wherein said step (a) further comprises the substeps of:

(i) converting the image from a radiation pulse into a video signal;

(ii) converting the video signal into a digital signal; and wherein said step (b) further comprises performing a pixel by pixel comparison of the digital signal to image data from a previous pulse to determine if motion has occurred between the pulses.

11. A method according to claim 8, further comprising the step of (e) repeating said steps (a) through (d) for each subsequent pulse.

12. A method according to claim 11, comprising the step of (f) returning the pulse rate to an original pulse rate when it is determined in said step (b) that the motion has ceased and that the brightness level is acceptable.

13. A fluoroscopy apparatus comprising:

an x-ray tube for transmitting x-ray pulses into an object to be examined;

an image intensifier for converting each x-ray pulse transmitted through the object into an optical image;

a photomultiplier tube positioned proximate to the image intensifier for converting at least a portion of the brightness from the optical image for each pulse into a corresponding current;

means for converting the present current into a corresponding voltage;

means for converting the voltage into a corresponding digital value;

means for comparing the digital value to a predetermined acceptable range of values which represent acceptable brightness levels for the image;

means for changing the kilovoltage at which the next pulse will be transmitted by said x-ray tube if the digital value is not within the predetermined range of values; and means for adjusting the rate at which the next pulse will be transmitted by said x-ray tube if the digital value is not within the predetermined range of values.

14. A fluoroscopy apparatus according to claim 13, wherein said means for changing the kilovoltage automatically increases the kilovoltage at which the next pulse will be transmitted if the digital value is less than the predetermined range of values and automatically decreases the kilovoltage at which the next pulse will be transmitted if the digital value is greater than the predetermined range of values.

15. A fluoroscopy apparatus according to claim 13, wherein said means for adjusting the rate automatically adjusts the rate to a predetermined pulse rate until the digital value for a subsequent pulse falls within the predetermined acceptable range of values.

16. A fluoroscopy apparatus comprising:

an x-ray tube for transmitting x-ray pulses into an object to be examined;

an image intensifier for converting each x-ray pulse transmitted through the object into an optical image;

a photomultiplier tube positioned proximate to the image intensifier for converting at least a portion of the brightness from the optical image for each pulse into a corresponding current;

means for converting the current into a corresponding voltage;

means for converting the voltage into a corresponding digital value;

means for comparing the digital value to a predetermined acceptable range of values which represent acceptable brightness levels for the image;

means for changing the kilovoltage at which the next pulse will be transmitted by said x-ray tube if the digital value is not within the predetermined range of values;

means for adjusting the rate at which the next pulse will be transmitted by said x-ray tube if the digital value is not within the predetermined range of values;

means for converting the optical image output by each pulse into a video signal;

means for converting the video signal into a digital signal; and means for comparing the digital signals produced by consecutive pulse to determine if motion has occurred between the pulses;

wherein said means for adjusting the pulse rate sets the rate at which the next pulse will be transmitted by said x-ray tube to a rate that will permit substantially real-time imaging until said means for comparing the digital signals determines that no motion is occurring between consecutive pulses.

* * * * *